US009964334B2

(12) United States Patent
Engler

(10) Patent No.: US 9,964,334 B2
(45) Date of Patent: May 8, 2018

(54) METHOD OF AND SYSTEM FOR FLAME SENSING AND DIAGNOSTIC

(71) Applicant: Lennox Industries Inc., Richardson, TX (US)

(72) Inventor: Michael Engler, Lucas, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days. days.

(21) Appl. No.: 15/713,817

(22) Filed: Sep. 25, 2017

(65) Prior Publication Data

US 2018/0010823 A1 Jan. 11, 2018

Related U.S. Application Data

(63) Continuation of application No. 15/015,600, filed on Feb. 4, 2016, now Pat. No. 9,803,889.

(60) Provisional application No. 62/112,300, filed on Feb. 5, 2015.

(51) Int. Cl.

| | |
|---|---|
| ***G08B 17/12*** | (2006.01) |
| ***F24H 9/20*** | (2006.01) |
| ***F23N 5/26*** | (2006.01) |
| ***F23N 5/24*** | (2006.01) |
| ***F23N 5/12*** | (2006.01) |

(52) U.S. Cl.

CPC ..... *F24H 9/2085* (2013.01); *F23N 5/123* (2013.01); *F23N 5/242* (2013.01); *F23N 5/265* (2013.01); *F23N 2031/06* (2013.01); *F23N 2041/02* (2013.01)

(58) Field of Classification Search

None

See application file for complete search history.

(56) References Cited

U.S. PATENT DOCUMENTS

| | | | | |
|---|---|---|---|---|
| 3,715,180 | A * | 2/1973 | Cordell | G05B 19/07 431/16 |
| 4,167,767 | A * | 9/1979 | Courier de Mere | F02P 17/12 361/256 |
| 5,506,569 | A | 4/1996 | Rowlette | |
| 5,548,277 | A * | 8/1996 | Wild | F23N 5/082 250/372 |
| 6,060,719 | A * | 5/2000 | DiTucci | F23N 5/082 250/554 |
| 2016/0164310 | A1* | 6/2016 | Juntunen | H02J 7/007 320/134 |

* cited by examiner

*Primary Examiner* — Julie Lieu

(74) *Attorney, Agent, or Firm* — Winstead PC

(57) ABSTRACT

A method of determining presence of a flame in a furnace of a heating, ventilation, and air conditioning (HVAC) system. The method comprises determining, using a controller, whether a processor signal (G) is active, responsive to a determination that the processor signal (G) is active, determining, using the controller prior to assertion of a flame-test input control signal, an output state of a first comparator, responsive to a determination that the output state of the first comparator is high, determining, using the controller prior to assertion of the flame-test input control signal, an output state of a second comparator, and responsive to a determination that the output state of the second comparator is low, transmitting, using the controller, a notification that a flame is present.

26 Claims, 6 Drawing Sheets

METHOD OF AND SYSTEM FOR FLAME SENSING AND DIAGNOSTIC

CROSS-REFERENCE TO RELATED APPLICATIONS

This patent application is a continuation application of U.S. patent application Ser. No. 15/015,600, filed on Feb. 4, 2016. U.S. patent application Ser. No. 15/015,600 claims the benefit of U.S. Provisional Application No. 62/112,300 filed on Feb. 5, 2015. U.S. patent application Ser. No. 15/015,600 and U.S. Provisional Application No. 62/112,300 are incorporated herein by reference.

TECHNICAL FIELD

The present invention relates generally to heating, ventilation, and air conditioning (HVAC) systems and, more particularly, but not by way of limitation, to gas flame control and sensing presence of a gas flame in furnaces of the HVAC systems.

BACKGROUND

HVAC systems can be used to regulate an environment within an enclosure. Typically, a circulating fan is used to pull air from the enclosure into the HVAC system through ducts and push the air back into the enclosure through additional ducts after conditioning the air (e.g., heating or cooling the air). For example, a gas furnace, such as a residential gas furnace, is used in a heating system to heat the air.

Flame rectification to sense presence or absence of a flame is conventional in gas furnace controls technology. Typically, a 120 volt AC power is coupled to a flame-probe through a first capacitor. When no flame is present, a second capacitor coupled to the flame-probe is charged to a selected value of, for example, 5 volts DC, through a resistor connected to a DC voltage source. A change of state device, such as an inverter, has an output connected to a microprocessor and an input connected to the second capacitor. When no flame is present, the second capacitor maintains the voltage at an input of the inverter above a threshold value so that an output of the inverter is low, thereby providing an indication to the microprocessor that there is no flame. When a flame is present, the second capacitor discharges to ground through the flame which acts as a poor diode connected in series with a resistor. When the second capacitor discharges to a level below the threshold, the inverter changes state with its output going high thereby providing an indication to the microprocessor that a flame is present.

SUMMARY

A method of determining presence of a flame in a furnace of a heating, ventilation, and air conditioning (HVAC) system. The method comprises determining, using a controller, whether a processor signal (G) is active, responsive to a determination that the processor signal (G) is active, determining, using the controller prior to assertion of a flame-test input control signal, an output state of a first comparator, responsive to a determination that the output state of the first comparator is high, determining, using the controller prior to assertion of the flame-test input control signal, an output state of a second comparator, and responsive to a determination that the output state of the second comparator is low, transmitting, using the controller, a notification that a flame is present.

A heating, ventilation, and air conditioning (HVAC) system comprising circuitry for determining presence of a flame. The circuitry comprises a flame detect circuit, a tank circuit, a first comparator, a second comparator, and a controller operatively coupled to the flame detect circuit, the tank circuit, the first comparator, and the second comparator. The controller is configured to determine whether a processor signal (G) is active, responsive to a determination that the processor signal (G) is active, determine, prior to assertion of a flame-test input control signal, an output state of a first comparator, responsive to a determination that the output state of the first comparator is high, determine, prior to assertion of the flame-test input control signal, an output state of a second comparator, and responsive to a determination that the output state of the second comparator is low, transmit a notification that a flame is present.

DETAILED DESCRIPTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

A problem exists with the prior approach described above, in view of the low level of current flow. If the inverter or the second capacitor develops too much leakage current to ground, an indication of the presence of a flame can occur even at times when, in fact, no flame is present. This can happen because of age, static damage, faulty components or the like.

Sensing presence of a flame is important for safety and effectively controlling operation of furnaces and other apparatuses using natural gas or another combustible fluid as a flame fuel source. For example, an absence or loss of the flame while fuel is being delivered causes a safety risk. Conversely, avoiding unnecessary shut-down of the furnace and other apparatus is important for continued, effective operation. It is desirable to reduce or eliminate the risk of erroneously sensing the presence of the flame in furnaces and the resulting delivery of fuel to burners without the fuel being burned. Accumulating unburned fuel is hazardous, in addition to being wasteful and inefficient. Exemplary embodiments disclose a method of and system for detecting presence or absence of the flame in furnaces and other apparatuses where a flame is generated.

Figure 1:
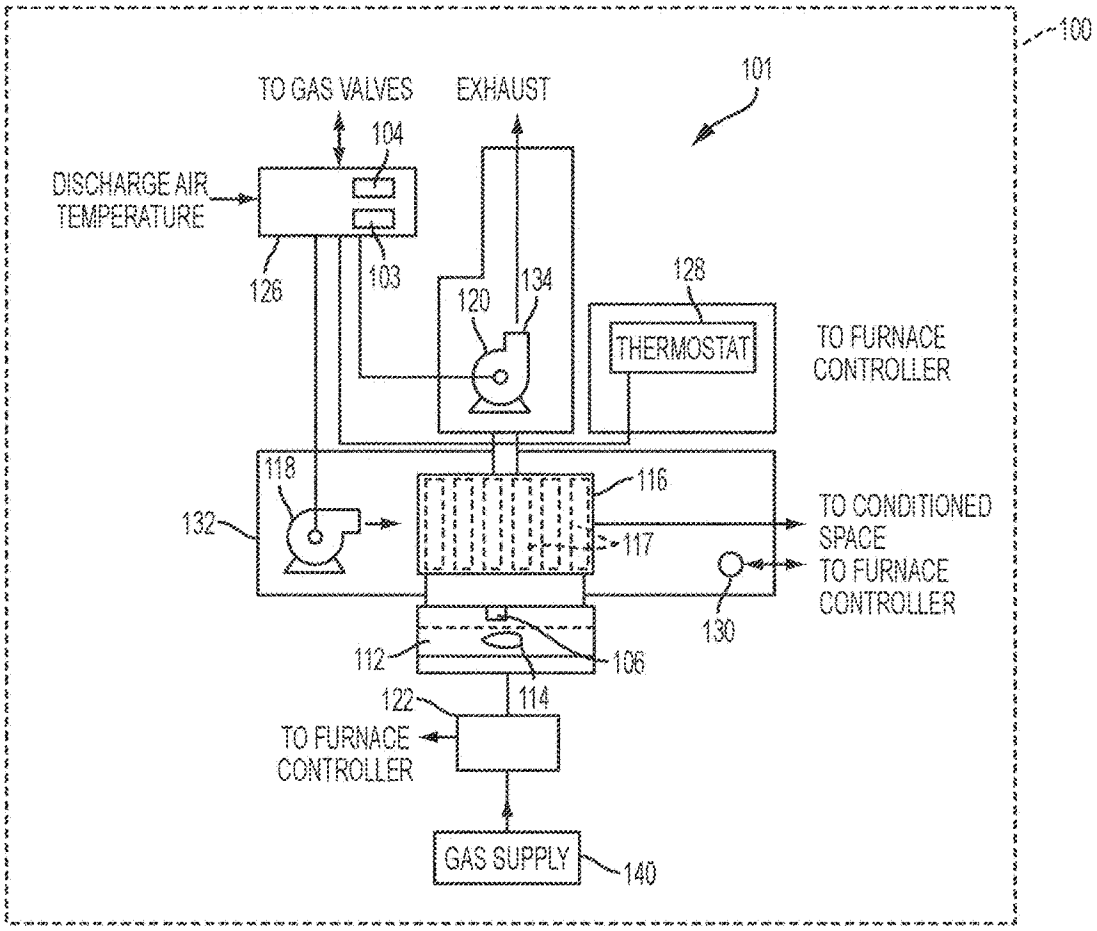
FIG. 1 illustrates an exemplary HVAC system employing a heating system.

FIG. 1 illustrates an exemplary HVAC system 100 employing a heating system 101. The heating system 101 is, for example, a gas fired combustible fuel-air burning furnace. The furnace may be for a residence or for a commercial building (i.e. a residential or commercial unit), for example a rooftop unit (RTU). The heating system 101 includes a burner assembly 112 having at least one burner 114, a heat exchanger 116, an air circulation fan 118, a combustion air-inducer or combustion air-blower (CAB) 120, a gas valve 122, and a furnace controller 126. The furnace controller 126 is operationally connected for example to the CAB 120, the gas valve 122, a thermostat 128, and a discharge air sensor (DAS) 130. The heating system 101 may be utilized in single or multiple zoned systems. Portions of the heating system 101 may be contained within a cabinet 132. In some embodiments, the furnace controller 126 may be included in the cabinet 132. One skilled in the art will also understand that the heating system 101 disclosed herein may include additional components and devices that are not presently illustrated or discussed.

The furnace controller 126 may include a memory section 103 having a series of operating instructions stored therein that direct the operation of the furnace controller 126 (e.g., the processor) when initiated thereby. The series of operating instructions may represent algorithms that are used to prevent or reduce temperature overshooting in the conditioned space. The furnace controller 126 also includes a printed circuit board (PCB) 104. As illustrated in FIG. 1, the furnace controller 126 is coupled to the DAS 130, the thermostat 128 and components of the heating system 101. The controller 126 may also be connected to other elements and systems, such as a zone controller. In some embodiments, the connections are through a wired-connection. A conventional cable and contacts may be used to couple the furnace controller 126 to the various components of the heating system 101. In some embodiments, a wireless connection may also be employed to provide at least some of the connections.

The burner assembly 112 includes the at least one burner 114 that is configured for burning a combustible fuel-air mixture (e.g., gas-air mixture) and to provide a combustion product to the heat exchanger 116. The heat exchanger 116 includes a plurality of tubes 117, for example a tube corresponding to each of the at least one burner 114. The heat exchanger 116 is configured to receive the combustion product from the burner assembly 112 and use the combustion product to heat air that is blown across the heat exchanger 116 by the air circulation fan 118. The air circulation fan 118 is configured to circulate air through the cabinet 132, whereby the circulated air is heated by the heat exchanger 116 and supplied to the conditioned space. The CAB 120 is configured to supply combustion air to the burner assembly 112 (i.e., the at least one burner 114) by an induced draft and is also used to exhaust waste products of combustion from the furnace through a vent 134. The burner assembly 112 also includes a flame sensing rod 106. The flame sensing rod 106 is configured to determine presence or absence of the flame. In some embodiments, the flame sensing rod 106 is positioned in the burner assembly 112 in front of the at least one burner 114. When an ignition source lights the at least one burner 114, the flame sensing rod 106 being in the path of the flame energizes circuitry that detects presence or absence of the flame.

Figure 2A:
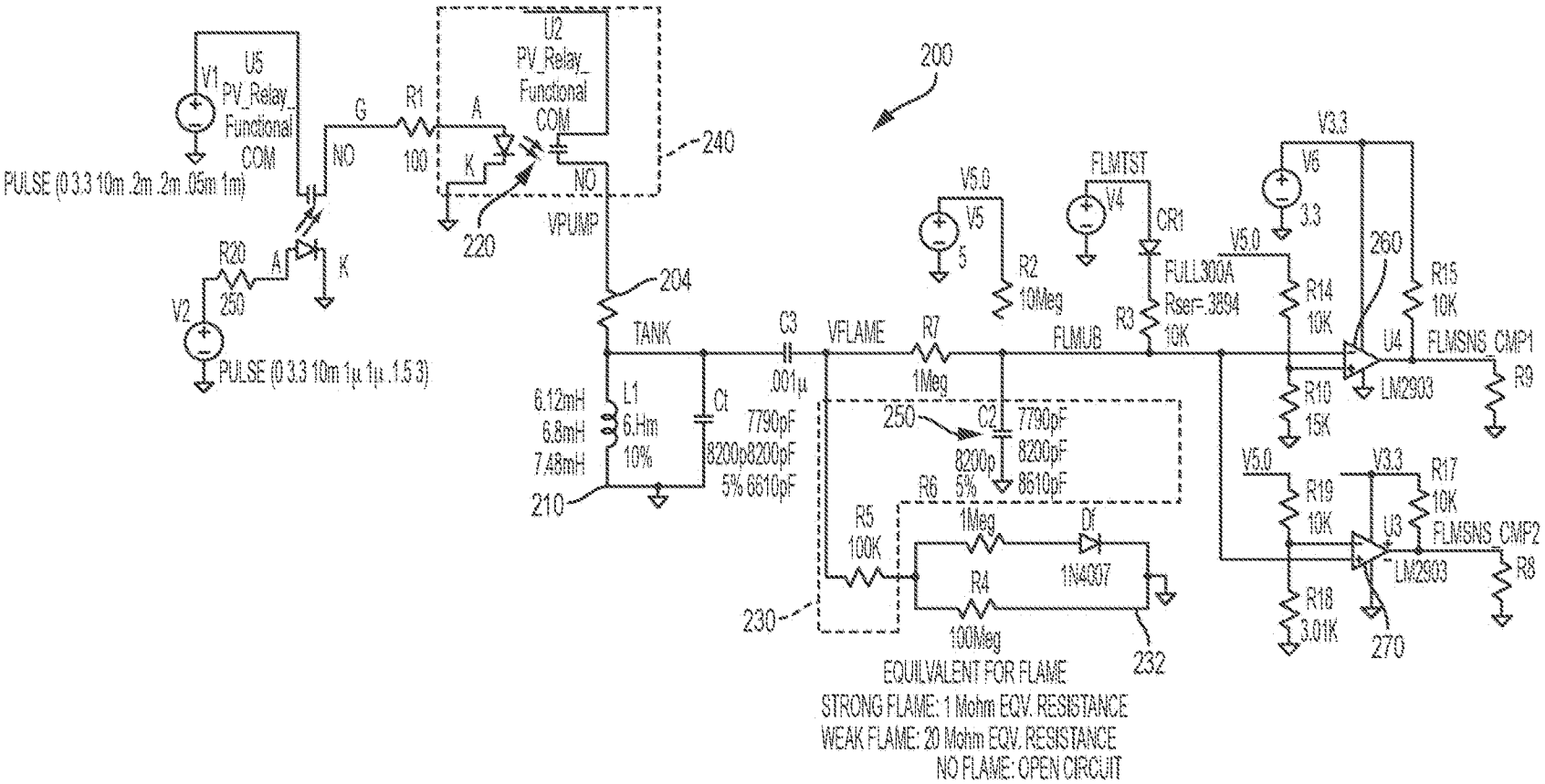
FIG. 2A is an exemplary simulator diagram of a circuit for flame detection.

FIG. 2A is an exemplary simulator diagram of a circuit 200 for flame detection. For illustrative purposes, the circuit 200 will be described relative to FIG. 1. In a typical embodiment, the circuit 200 is utilized in the printed circuit board (PCB) 104 of the HVAC system 100 or another apparatus requiring flame detection and control. The circuit 200 is configured to monitor the burner assembly 112 to determine presence or absence of the flame during ON and OFF cycles. The circuit 200 includes an LC circuit 210, also referred to herein as a tank circuit. In the exemplary embodiment shown, the tank circuit 210 includes an inductor (L1) and a capacitor (C1) connected in parallel. In some embodiments, a voltage of the tank circuit 210 is adjusted by, for example, varying the inductor (L1) and capacitor (C1) values of the tank circuit 210, as well as a duty cycle of a processor signal (G). In some embodiments, the tank circuit 210 may be tuned to approximately 20 kHz and may be periodically recharged from a 20-25V DC power supply (not explicitly illustrated). In a typical embodiment, the processor signal (G) is configured to gate a photovoltaic field-effect transistor (FET) 220 to allow a direct-current (DC) input signal to feed the tank circuit 210 from the 20-25V DC power supply at predefined intervals such as, for example, every 1 ms.

The circuit 200 further includes a flame detect circuit 230, a flame simulation circuit 232, a relay circuit 240, a first comparator 260, and a second comparator 270. In a typical embodiment, the flame detect circuit 230 is configured to determine presence or absence of the flame. In some embodiments, the flame sensing rod 106 is positioned in the burner assembly 112 in front of the at least one burner 114. When an ignition source lights the at least one burner 114, the flame sensing rod 106 is in the path of the flame and energizes the flame detect circuit 230. In some embodiments, the photovoltaic FET 220 within the relay circuit 240 is configured to decouple the voltage of the processor signal (G) from the input DC signal (Vpump) to enhance an accuracy of voltage control at a rate of G control pulses. In some embodiments, the tank circuit 210 may be pumped to a peak voltage of approximately 60V and may rapidly decay as the tank circuit 210 discharges through the flame detect circuit 230 when a flame is present.

The circuit 200 utilizes a plurality of input control signals and a plurality of output-detect signals to determine presence or absence of the flame. For example, the plurality of input control signals include the processor signal (G) and a flame-test input control signal (FLMTST). The plurality of output-detect signals include a first-output-detect signal (FLMSNS_CMP1), which is an output signal of the first comparator 260, and a second-output-detect signal (FLMSNS_CMP2), which is an output signal of the second comparator 270. In various embodiments, a voltage of the tank circuit 210 is adjusted, for example, by varying the inductor (L1) and capacitor (C1) values of the tank circuit 210, as well as a duty cycle of the processor signal (G). In some embodiments, a peak current through the relay circuit 240 may be adjusted, for example, by varying a value of a series resistor 204 between the relay circuit 240 and the tank circuit 210 so that the peak current remains below a peak current rating of the relay circuit 240. In a typical embodiment, the tank circuit 210 generates an alternating current (AC) signal of approximately 120 volts peak to peak.

In a typical embodiment, when a flame is present, the tank circuit 210 and a test pulse capacitor 250 within the flame detect circuit 230 discharge through the flame via the flame detect circuit 230. In various embodiments, the rate of discharge depends on the strength of the flame. For example, the stronger the flame, the faster is the rate of discharge. In a typical embodiment, the flame-test input control signal (FLMTST) may be used to inject, for example, a 5V pulse to charge the test pulse capacitor 250 so that the first comparator 260 may sense, for example, the flame strength. This may be done by a processor (e.g., furnace controller 126) measuring a time period from a time of removal of the flame-test input control signal (FLMTST) to a rising edge of a first comparator output signal (FLMSNS_CMP1) as a first comparator input signal (FLMUB) decays to 3V from the fully charged 5V of the test pulse capacitor 250. A second comparator 270 generates a second comparator output signal (FLMSNS_CMP2), which serves as a functionality check of the circuit 200 to determine a component failure. The functionality check may avoid an indication that a flame is sensed, and present, when no flame is present.

In various embodiments, a functionality check of the circuit 200 performed by, for example, the furnace controller 126, may be as follows:

- Upon proper detection of a flame and prior to assertion of the flame-test input control signal (FLMTST), the first comparator output signal (FLMSNS_CMP1) is high while the second comparator output signal (FLMSNS_CMP2) is low.
- Upon assertion of the flame-test input control signal (FLMTST), the first comparator output signal (FLMSNS_CMP1) goes low while the second input signal (FLMSNS_CMP2) goes high then flip states again after a delay proportional to the flame strength.
- When the tank circuit 210 is not actively running such as, for example, when the processor signal (G) is low, the first comparator output signal (FLMSNS_CMP1) and the second comparator output signal (FLMSNS_CMP2) are both high prior to the flame-test input control signal (FLMTST) being asserted.
- Upon assertion of the flame-test input control signal (FLMTST), the first comparator output signal (FLMSNS_CMP1) goes low while the second comparator output signal (FLMSNS_CMP2) remains high. The first comparator output signal (FLMSNS_CMP1) flips state back to high after a short delay.
- When no flame is detected, the first comparator output signal (FLMSNS_CMP1) is low and the second comparator output signal (FLMSNS_CMP2) is high regardless of the action of the flame-test input control signal (FLMTST).
- If both the first comparator output signal (FLMSNS_CMP1) and the second comparator output signal (FLMSNS_CMP2) are low, a problem with the comparator circuit exists. Appendix A of U.S. Provisional Application No. 62/112,300 illustrates a number of flame-sense simulations, including simulations of various potential problem conditions.
- If the flame sensing rod 106 is shorted to ground, the first comparator output signal (FLMSNS_CMP1) and the second comparator output signal (FLMSNS_CMP2) behaves similar to when the processor signal (G) is active (e.g., high). When the processor signal (G) is inactive (e.g., low), the second comparator output signal (FLMSNS_CMP2) does not remain high as it did before under normal operating conditions but changes state upon assertion of the flame-test input control signal (FLMTST).

As stated above, the flame-test input control signal (FLMTST) is configured to charge the test pulse capacitor 250 by injecting, for example, a 5V pulse, so that the first comparator 260 may sense the flame strength. This may be done by the furnace controller 126 measuring the time period from a time of removal of the flame-test input control signal (FLMTST) to a rising edge of a first comparator output signal (FLMSNS_CMP1) as a first comparator input signal (FLMUB) decays to 3V from the fully charged 5V of the test pulse capacitor 250.

Figure 2B:
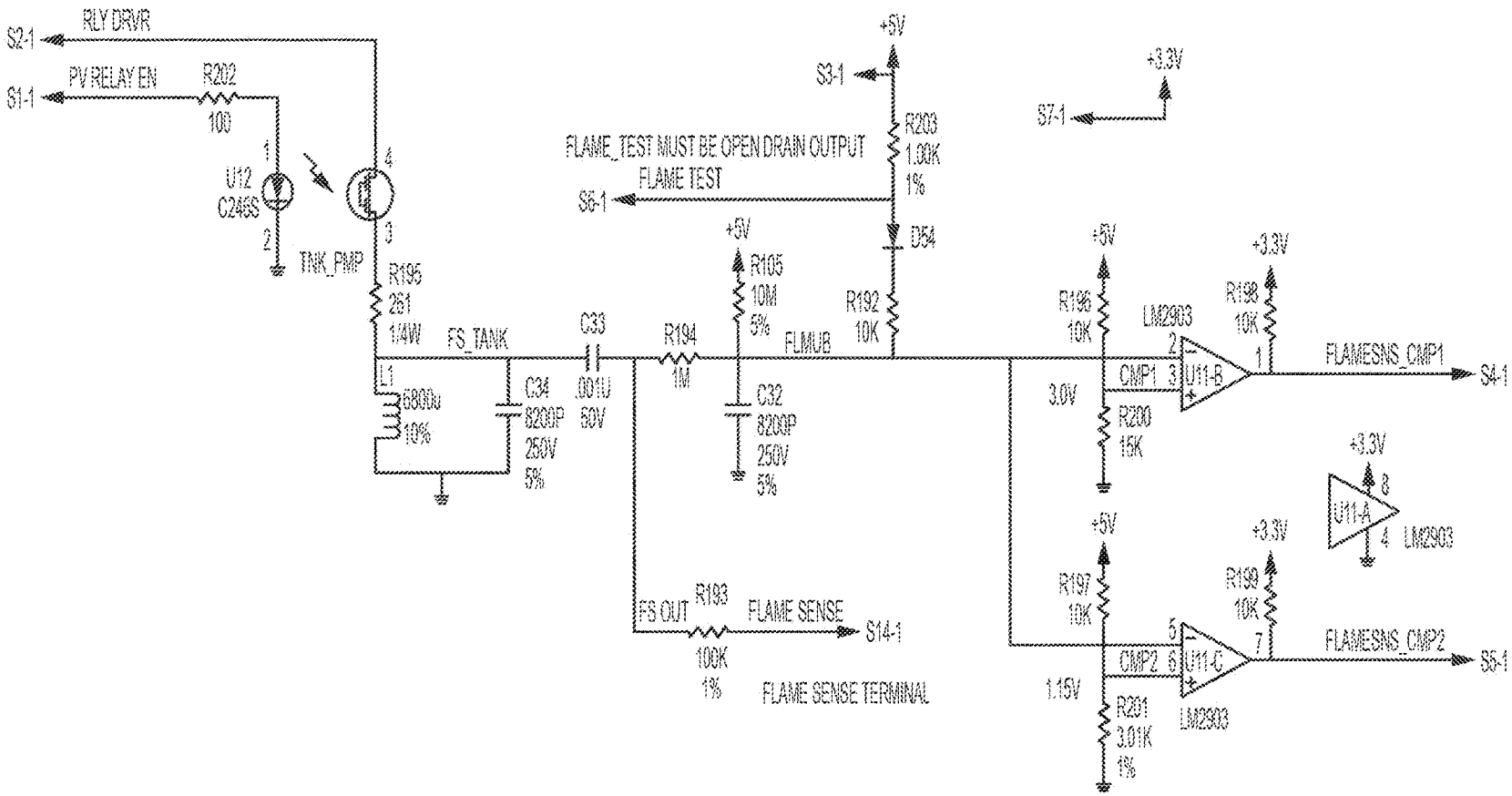
FIG. 2B is an exemplary circuit for flame detection.

FIG. 2B is an exemplary circuit 280 for flame detection. In FIG. 2B, like reference numerals are used to indicate like components. In FIG. 2B, the flame simulation circuit 232 is not shown because an actual flame condition would be sensed.

Figure 3A:
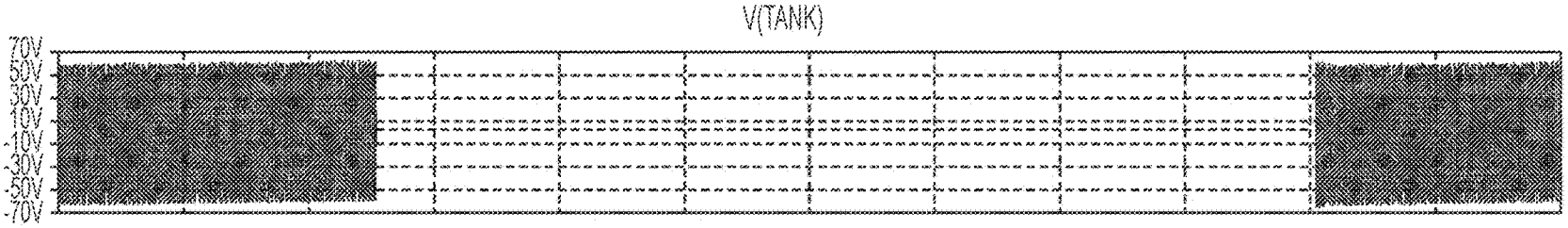
FIGS. 3A-3F illustrate exemplary voltage amplitude waveforms relative to time of signals generated using the circuit of FIG. 2A.

FIG. 3A illustrates a signal V[tank] generated by the tank circuit 210, when the processor signal G causes the relay circuit 240 to pump the tank circuit 210 to a peak voltage of approximately 60V.

Figure 3B:
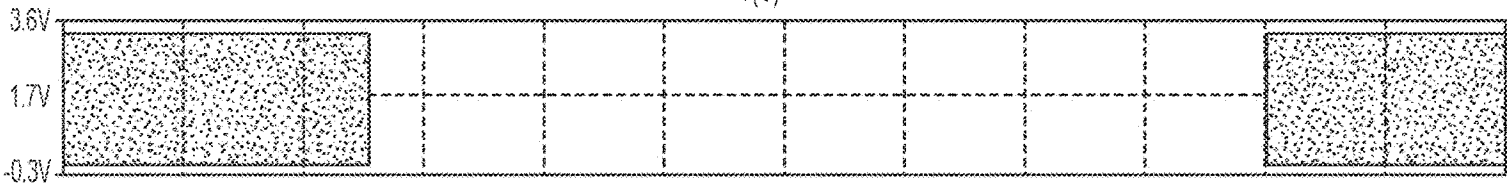

FIG. 3B illustrates a signal V[g] of the processor signal G, which causes the relay circuit 240 to pump the tank circuit 210.

Figure 3C:
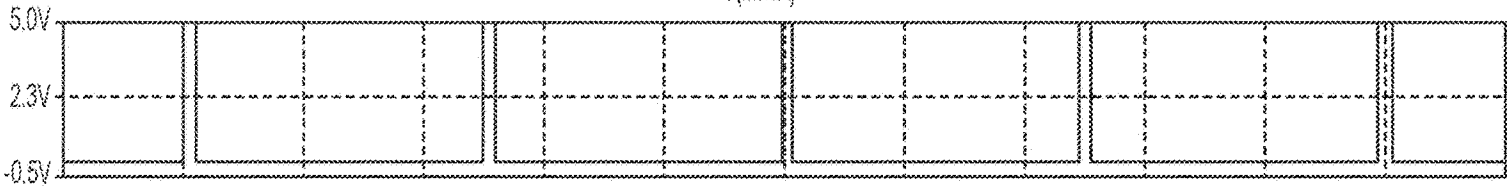
Figure 3D:
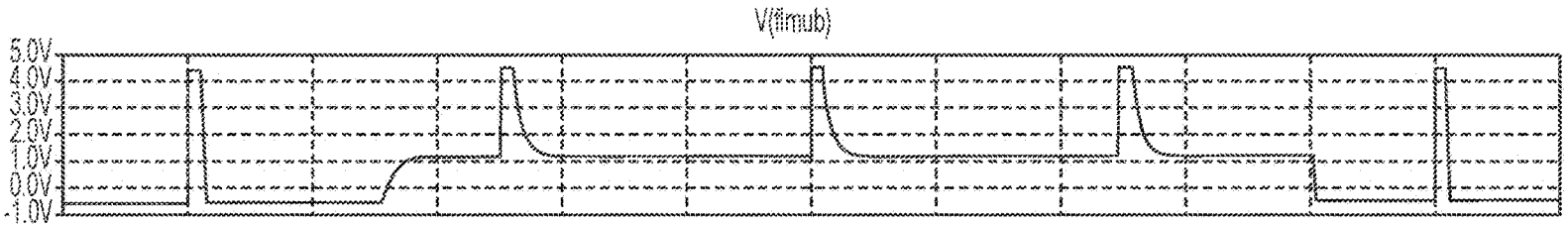

FIGS. 3C and 3D illustrate signal V[flmtst] (in solid lines) charging the capacitor 250 within the flame detect circuit 230 and signal V[flmub] (in wavy lines) from the capacitor 250 during charge and during decay in the presence of a flame when signal V[flmst] drops to zero.

Figure 3E:
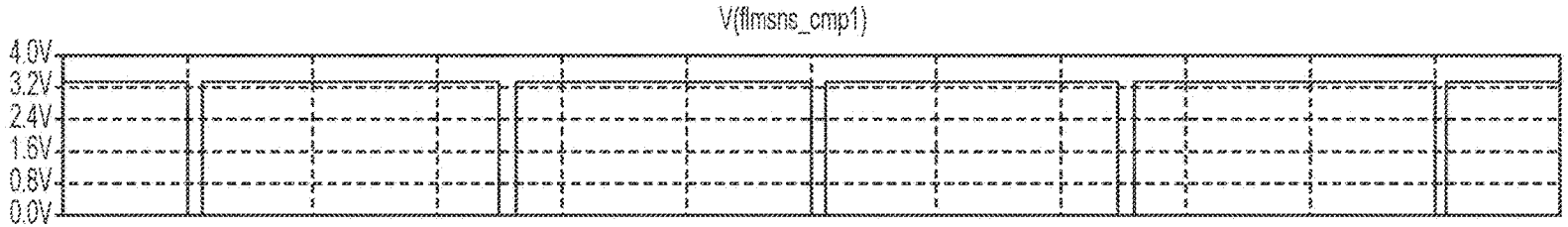

FIG. 3E illustrates signal V[flmsns_cmp1] from the first comparator 260, as signal V[flmub] from the capacitor 250 varies during charge and during decay in the presence of a flame. In some embodiments, the first comparator 260 may be set to output a signal V[flmsns_cmp1] when signal V[flmub] indicates that the capacitor 250 has discharged to a predetermined level or value.

Figure 3F:
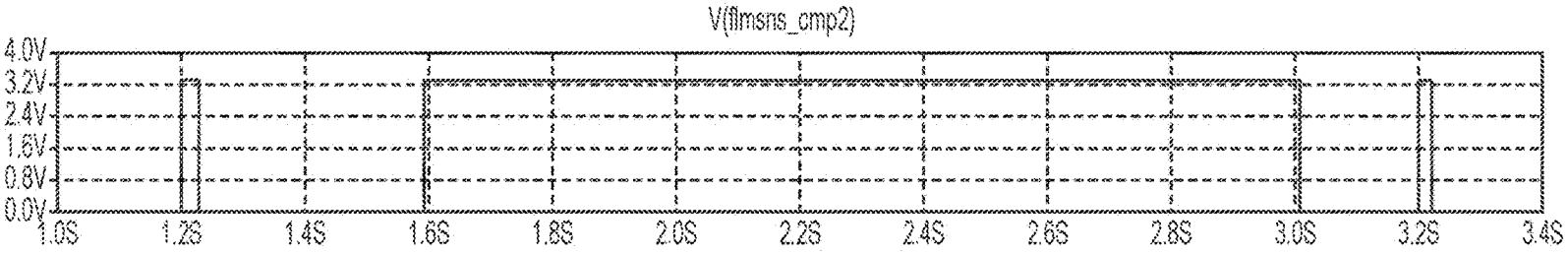

FIG. 3F illustrates signal V[flmsns_cmp2] from the second comparator 270, as signal V[flmub] from the capacitor 250 varies during charge and during decay in the presence of a flame. In some embodiments, the second comparator 270 may be set inversely to the first comparator 260 to discontinue signal V[flmsns_cmp2] output when signal V[flmub] indicates that the capacitor 250 has discharged to a predetermined level or value.

Referring now to FIGS. 1-2B and 3C-3E, in various embodiments, the furnace controller 126 is configured to determine the strength of the flame in an absolute sense and relative to other flame settings and other flame operations, by measuring a time lapse between flame test signal V[flmtst] dropping to zero and the first comparator 260 signal V[flmsns_cmp1] output. This results in the capacitor 250 discharging more rapidly in the presence of a stronger flame. Accordingly, a shorter time lapse would indicate a stronger flame, and a longer time lapse would indicate a weaker flame.

Referring again to FIGS. 1-2A and 3E-3F, the first and second comparators 260 and 270 may be set to output and discontinue output of their respective signals (V[flmsns_cmp1], V[flmsns_cmp2]) at different charge levels or values of the capacitor 250. In various embodiments, the furnace controller 126 is configured to measure the time lapse between such events to determine the rate of discharge of the capacitor 250 and thereby determine the strength or weakness of the flame. Furthermore, setting of the first and second comparators 260 and 270 at different charge levels of the capacitor 250 causes their respective signals to change at different times, thus providing a further indication to, for example, the furnace controller 126 that the first and second comparators 260 and 270 are operating correctly.

Figure 4:
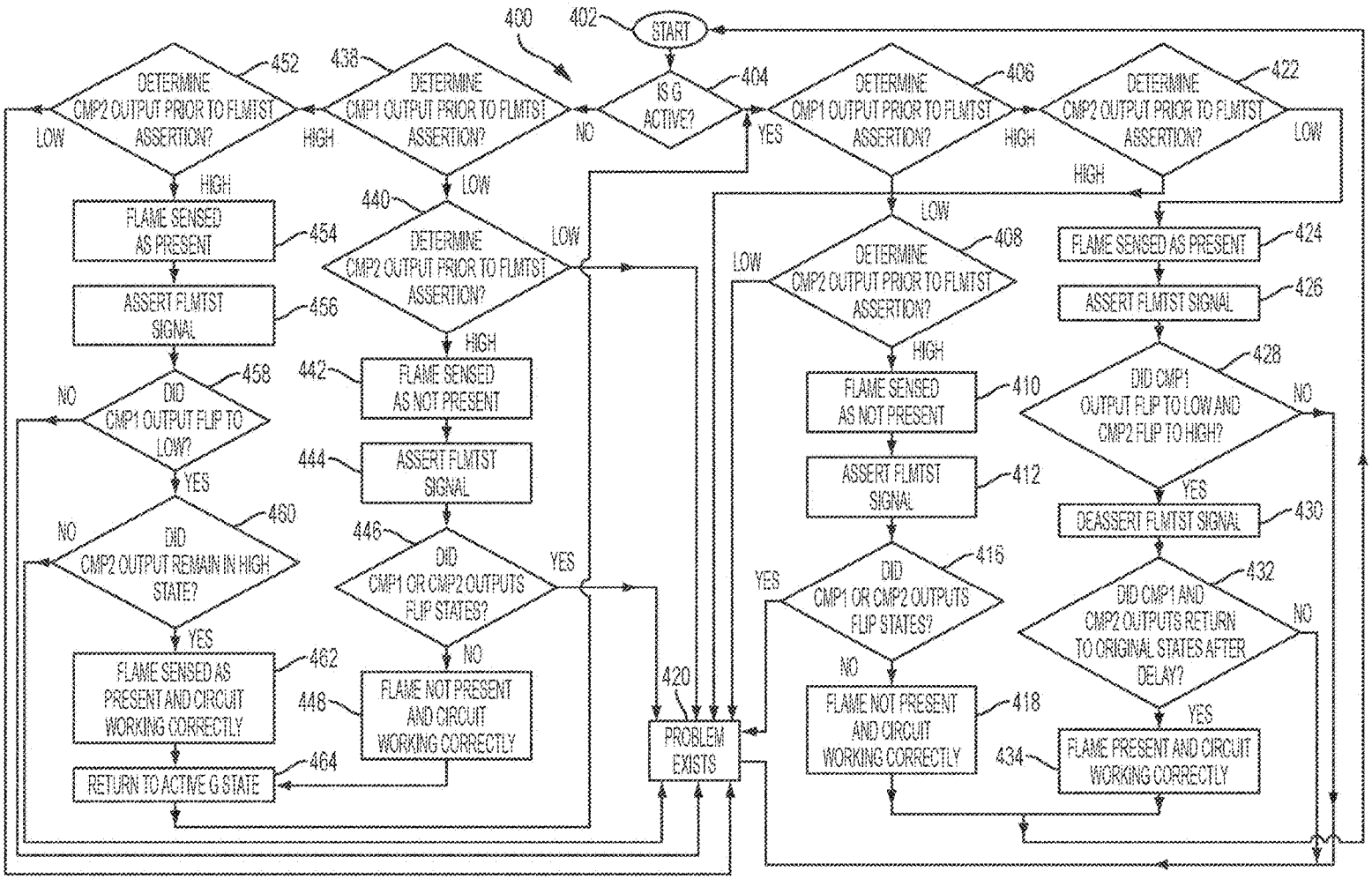
FIG. 4 is a flow chart illustrating an exemplary process for detecting presence of a flame.

FIG. 4 is a flow chart illustrating an exemplary process 400 for detecting presence of a flame. For illustrative purposes, the process 400 will be described relative to FIGS. 1-3F. The process 400 starts at step 402. At step 404, the furnace controller 126 determines whether the processor signal (G) is active (e.g., high) or inactive (e.g., low). If it is determined at step 404 that the processor signal (G) is active, the process 400 proceeds to step 406. At step 406, the furnace controller 126 determines, prior to assertion of a flame-test input control signal (FLMTST), whether an output of the first comparator 260 is low or high. If it is determined at step 406 that the output of the first comparator 260 is low, the process 400 proceeds to step 408. At step 408, the furnace controller 126 determines, prior to assertion of the flame-test input control signal (FLMTST), whether an output of the second comparator 270 is low or high. If it is determined at step 408 that the output of the second comparator 270 is low, the process 400 proceeds to step 420. At step 420, the furnace controller 126 provides an indication that a problem exists in the circuit 200.

However, if it is determined at step 408 that the output of the second comparator 270 is high, the process 400 proceeds to step 410. At step 410, the furnace controller 126 provides an indication that no flame is present. As described above, the flame-test input control signal (FLMTST) may be used to inject, for example, a 5V pulse to charge the test pulse capacitor 250 so that the first comparator 260 may sense, for example, the flame strength. This may be done by the processor (e.g., furnace controller 126) measuring a time period from the time of removal of the flame-test input control signal (FLMTST) to the rising edge of the first comparator output signal (FLMSNS_CMP1) as the first comparator input signal (FLMUB) decays to 3V from the fully charged 5V of the test pulse capacitor 250.

From step 410, the process proceeds to step 412. At step 412, the flame-test input control signal (FLMTST) is asserted. From step 412, the process 400 proceeds to step 416. At step 416, the furnace controller 126 determines whether the output of the first comparator 260 flips from low to high and the output of the second comparator 270 flips from high to low. If it is determined at step 416 that the output of the first comparator 260 flips from low to high or the output of the second comparator 270 flips from high to low, the process 400 proceeds to step 420 indicating that a problem exists in the circuit 200. However, if it is determined at step 416 that neither condition described in step 416 is true, the process 400 proceeds to step 418. At step 418, the furnace controller 126 provides an indication that flame is not present and the circuit 200 is working correctly.

However, if it is determined at step 406 that the output of the first comparator 260 is high, the process 400 proceeds to step 422. At step 422, the furnace controller 126 determines, prior to assertion of the flame-test input control signal (FLMTST), whether the output of the second comparator 270 is low or high. If it is determined at step 422 that the output of the second comparator 270 is high, the process 400 proceeds to step 420 indicating that a problem exists in the circuit 200. However, if it is determined at step 422 that the output of the second comparator 270 is low, the process 400 proceeds to step 424. At step 424, the furnace controller 126 provides an indication that flame is present. From step 424, the process 400 proceeds to step 426.

At step 426, the flame-test input control signal (FLMTST) is asserted. From step 426, the process 400 proceeds to step 428. At step 428, the furnace controller 126 determines whether the output of the first comparator 260 flips from high to low and the output of the second comparator 270 flips from low to high. If it is determined at step 428 that the output of the first comparator 260 flips from high to low and the output of the second comparator 270 flips from low to high, the process 400 proceeds to step 430. However, if it is determined at step 428 that the at least one condition described in step 428 is not true, the process 400 proceeds to step 420 indicating that a problem exists in the circuit 200. At step 430, the flame-test input control signal (FLMTST) is deasserted. From step 430, the process proceeds to step 432. At step 432, the furnace controller 126 determines whether the outputs of the first comparator 260 and second comparator 270 return to the original state. If it is determined at step 432 that the at least one condition described in step 432 is not true, the process 400 proceeds to step 420 indicating that a problem exists in the circuit 200. However, if it is determined at step 432 that the outputs of the first comparator 260 and second comparator 270 return to the original state, the process 400 proceeds to step 434. At step 434, the furnace controller 126 provides an indication that flame is present and the circuit 200 is working correctly. From steps 418 and 434, the process 400 returns to step 402.

However, if it is determined at step 404 that the processor signal (G) is inactive, the process 400 proceeds to step 438. At step 438, the furnace controller 126 determines, prior to assertion of a flame-test input control signal (FLMTST), whether an output of the first comparator 260 is low or high. If it is determined at step 438 that the output of the first comparator 260 is low, the process 400 proceeds to step 440. At step 440, the furnace controller 126 determines, prior to assertion of the flame-test input control signal (FLMTST), whether an output of the second comparator 270 is low or high. If it is determined at step 440 that the output of the second comparator 270 is low, the process 400 proceeds to step 420. At step 420, the furnace controller 126 provides an indication that a problem exists in the circuit 200. However, if it is determined at step 440 that the output of the second comparator 270 is high, the process 400 proceeds to step 442. At step 442, the furnace controller 126 provides an indication that no flame is present.

From step 442, the process 400 proceeds to step 444. At step 444, the flame-test input control signal (FLMTST) is asserted. From step 444, the process 400 proceeds to step 446. At step 446, the furnace controller 126 determines whether the output of the first comparator 260 flips from low to high and the output of the second comparator 270 flips from high to low. If it is determined at step 446 that the output of the first comparator 260 flips from low to high or the output of the second comparator 270 flips from high to low, the process 400 proceeds to step 420 indicating that a problem exists in the circuit 200. However, if it is determined at step 446 that the both conditions described in step 446 are not true, the process 400 proceeds to step 448. At step 448, the furnace controller 126 provides an indication that flame is not present and the circuit 200 is working correctly. From step 448, the process 400 proceeds to step 464. At step 464, the processor signal (G) is active (e.g., high).

However, if it is determined at step 438 that the output of the first comparator 260 is high, the process 400 proceeds to step 452. At step 452, the furnace controller 126 determines, prior to assertion of the flame-test input control signal (FLMTST), whether the output of the second comparator 270 is low or high. If it is determined at step 452 that the output of the second comparator 270 is low, the process 400 proceeds to step 420 indicating that a problem exists in the circuit 200. However, if it is determined at step 452 that the output of the second comparator 270 is high, the process 400 proceeds to step 454. At step 454, the furnace controller 126 provides an indication that flame is present. From step 454, the process 400 proceeds to step 456.

At step 456, the flame-test input control signal (FLMTST) is asserted. From step 456, the process 400 proceeds to step 458. At step 458, the furnace controller 126 determines whether the output of the first comparator 260 flips from high to low. If it is determined at step 458 that the output of the first comparator 260 does not flip from high to low, the process 400 proceeds to step 420 indicating that a problem exists in the circuit 200. However. if it is determined at step 458 that the output of the first comparator 260 flips from high to low, the process 400 proceeds to step 460. At step 460, the furnace controller 126 determines whether the output of the second comparator 270 remains high. If it is determined at step 460 that the output of the second comparator 270 flips from high to low, the process 400 proceeds to step 420 indicating that a problem exists in the circuit 200. However, if it is determined at step 460 that the output of the second comparator 270 remains high, the process 400 proceeds to step 462. At step 462, the furnace controller 126 provides an indication that flame is present and the circuit 200 is working correctly. From step 424, the process 400 proceeds to step 464.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the furnace controller 126, one or more portions of the system memory, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method of determining presence of a flame in a furnace of a heating, ventilation, and air conditioning HVAC) system, the method comprising:

determining, using a controller, whether a processor signal (G) is active;

responsive to a determination that the processor signal (G) is active, determining, using the controller prior to assertion of a flame-test input control signal, an output state of a first responsive to a determination that the output state of the first comparator is high, determining, using the controller prior to assertion of the flame-test input control signal, an output state of a second comparator; and responsive to a determination that the output state of the second comparator is high, transmitting, using the controller, a notification that a problem exists.

2. The method of claim 1 further comprising:

asserting the flame-test input control signal;

determining, using the controller, whether the output state of the first comparator flips from high to low and the output state of the second comparator flips from low to high;

responsive to a determination that the output state of the first comparator does not flip from high to low or the output state of the second comparator does not flip from low to high, transmitting, using the controller, a notification that a problem exists;

responsive to a determination that the output state of the first comparator flips from high to low and the output state of the second comparator flips from low to high, deasserting the flame-test input control signal;

determining, using the controller, whether the output state of the first comparator flips from low to high and the output state of the second comparator flips from high to low;

responsive to a determination that the output state of the first comparator does not flip from low to high or the output state of the second comparator does not flip from high to low, transmitting, using the controller, the notification that the problem exists; and responsive to a determination that the output state of the first comparator flips from low to high and the output state of the second comparator flips from high to low, transmitting, using the controller, a notification that a flame is present and no problem exists.

3. The method of claim 1 further comprising:

responsive to a determination that the output state of the second comparator is low, transmitting, using the controller, a notification that a flame is present.

4. The method of claim 1 further comprising:

responsive to a determination that the output state of the first comparator is low, determining, using the controller prior to assertion of the flame-test input control signal, the output state of the second comparator;

responsive to a determination that the output state of the second comparator is low, transmitting, using the controller, a notification that a problem exists;

responsive to a determination that the output state of the second comparator is high, transmitting, using the controller, a notification that no flame is present;

asserting the flame-test input control signal;

determining, using the controller, whether the output state of the first comparator flips from low to high and the output state of the second comparator flips from high to low;

responsive to a determination that the output state of the first comparator does not flip from low to high and the output state of the first comparator does not flip from high to low, transmitting, using the controller, a notification that a flame is not present and no problem exists; and responsive to a determination that the output state of the first comparator flips from low to high or the output state of the second comparator flips from high to low, transmitting, using the controller, the notification that the problem exists.

5. The method of claim 1 further comprising:

responsive to a determination that the processor signal (G) is inactive, determining, using the controller prior to assertion of the flame-test input control signal, the output state of the first comparator;

responsive to a determination that the output state of the first comparator is low, determining, using the controller prior to assertion of the flame-test input control signal, the output state of the second comparator;

responsive to a determination that the output state of the second comparator is high, transmitting, using the controller, a notification that a flame is not present; and responsive to a determination that the output state of the second comparator is low, transmitting, using the controller, a notification that a problem exists.

6. The method of claim 5 further comprising:

asserting the flame-test input control signal;

determining, using the controller, whether the output state of the first comparator flips from low to high and the output state of the second comparator flips from high to low;

responsive to a determination that the output state of the first comparator does not flip from low to high and the output state of the second comparator does not flip from high to low, transmitting, using the controller, a notification that a flame is not present and no problem exists; and responsive to a determination that the output state of the first comparator flips from low to high or the output state of the second comparator flips from high to low, transmitting, using the controller, the notification that the problem exists.

7. The method of claim 5 further comprising:

responsive to a determination that the output state of the first comparator is high, determining, using the controller prior to assertion of the flame-test input control signal, the output state of the second comparator; and responsive to a determination that the output state of the second comparator is low, transmitting, using the controller, the notification that the problem exists.

8. The method of claim 7 further comprising:

responsive to a determination that the output state of the second comparator is high, transmitting, using the controller, a notification that a flame is present.

9. The method of claim 8 further comprising:

asserting the flame-test input control signal;

determining, using the controller, whether the output state of the first comparator flips from high to low;

responsive to a determination that the output state of the first comparator does not flip from high to low, transmitting, using the controller, the notification that the problem exists;

responsive to a determination that the output state of the first comparator flips from high to low, determining, using the controller, whether the output state of the second comparator does not flip from high to low;

responsive to a determination that the output state of the second comparator does flip from high to low, transmitting, using the controller, the notification that the problem exists; and responsive to a determination that the output state of the second comparator does not flip from high to low, transmitting, using the controller, a notification that a flame is present and no problem exists.

10. The method of claim 1, wherein the flame-test input control signal is configured to charge components of system circuitry.

11. The method of claim 1, wherein the controller comprises a memory having a series of operating instructions stored therein for directing operation of the controller.

12. The method of claim 1, wherein the HVAC system comprises a heating system.

13. A circuit for determining presence of a flame, the circuit utilized in a printed circuit board (PCB) of a heating, ventilation, and air conditioning (HVAC) system, the circuit comprising:

a flame detect circuit;

a tank circuit;

a first comparator;

a second comparator; and a controller operatively coupled to the flame detect circuit, the tank circuit, the first comparator, and the second comparator, wherein the controller is configured to:

determine whether a processor signal (G) is active;

responsive to a determination that the processor signal (G) is active, determine, prior to assertion of a flame-test input control signal, an output state of a first comparator;

responsive to a determination that the output state of the first comparator is high, determine, prior to assertion of the flame-test input control signal, an output state of a second comparator; and responsive to a determination that the output state of the second comparator is high, transmit a notification that a problem exists.

14. The circuit of claim 13, wherein the controller is further configured to:

assert the flame-test input control signal;

determine whether the output state of the first comparator flips from high to low and the output state of the second comparator flips from low to high;

responsive to a determination that the output state of the first comparator does not flip from high to low or the output state of the second comparator does not flip from low to high, transmit a notification that a problem exists;

responsive to a determination that the output state of the first comparator flips from high to low and the output state of the second comparator flips from low to high, deassert the flame-test input control signal;

determine whether the output state of the first comparator flips from low to high and the output state of the second comparator flips from high to low;

responsive to a determination that the output state of the first comparator does not flip from low to high or the output state of the second comparator does not flip from high to low, transmit the notification that the problem exists; and responsive to a determination that the output state of the first comparator flips from low to high and the output state of the second comparator flips from high to low, transmit a notification that a flame is present and no problem exists.

15. The circuit of claim 13, wherein the controller is further configured to:

responsive to a determination that the output state of the second comparator is low, transmit a notification that a flame is present.

16. The circuit of claim 13, wherein the controller is further configured to:

responsive to a determination that the output state of the first comparator is low, determine, using the controller prior to assertion of the flame-test input control signal, the output state of the second comparator;

responsive to a determination that the output state of the second comparator is low, transmit, a notification that a problem exists;

responsive to a determination that the output state of the second comparator is high, transmit, a notification that no flame is present;

assert the flame-test input control signal;

determine whether the output state of the first comparator flips from low to high or the output state of the second comparator flips from high to low;

responsive to a determination that the output state of the first comparator does not flip from low to high and the output state of the first comparator does not flip from high to low, transmit a notification that a flame is not present and no problem exists; and responsive to a determination that the output state of the first comparator flips from low to high or the output state of the second comparator flips from high to low, transmit the notification that the problem exists.

17. The circuit of claim 13, wherein the controller is further configured to:

responsive to a determination that the processor signal (G) is inactive, determine, prior to assertion of the flame-test input control signal, the output state of the first comparator;

responsive to a determination that the output state of the first comparator is low, determine, prior to assertion of the flame-test input control signal, the output state of the second, comparator;

responsive to a determination that the output state of the second comparator is high, transmit a notification that a flame is not present; and responsive to a determination that the output state of the second comparator is low, transmit a notification that a problem exists.

18. The circuit of claim 17, wherein the controller is further configured to:

assert the flame-test input control signal;

determine whether the output state of the first comparator flips from low to high or the output state of the second comparator flips from high to low;

responsive to a determination that the output state of the first comparator does not flip from low to high and the output state of the second comparator does not flip from high to low, transmit a notification that a flame is not present and no problem exists; and responsive to a determination that the output state of the first comparator flips from low to high or the output state of the second comparator flips from high to low, transmit the notification that the problem exists.

19. The circuit of claim 17, wherein the controller is further configured to:

responsive to a determination that the output state of the first comparator is high, determine, prior to assertion of the flame-test input control signal, the output state of the second comparator; and responsive to a determination that the output state of the second comparator is low, transmit the notification that the problem exists.

20. The circuit of claim 19, wherein the controller is further configured to:

responsive to a determination that the output state of the second comparator is high, transmit a notification that a flame is present.

21. The circuit of claim 20, wherein the controller is further configured to:

assert the flame-test input control signal;

determine whether the output state of the first comparator flips from high to low;

responsive to a determination that the output state of the first comparator does not flip from to low, transmit the notification that the problem exists;

responsive to a determination that the output state of the first comparator flips from high to low, determine whether the output state of the second comparator does not flip from high to low;

responsive to a determination that the output state of the second comparator does flip from to low, transmit the notification that the problem exists; and responsive to a determination that the output state of the second comparator does not flip from high to low, transmit a notification that a flame is present and no problem exists.

22. The circuit of claim 13, wherein the tank circuit comprises an inductor and a capacitor connected in parallel.

23. The circuit of claim 22, wherein the flame detect circuit comprises a test pulse capacitor.

24. The circuit of claim 22, wherein, upon assertion of the flame-test input control signal, the tank circuit and the test pulse capacitor becomes energized.

25. A method of determining presence of a flame in a furnace of a heating, ventilation, and air conditioning (HVAC) system, the method comprising:

determining, using a controller, whether a processor signal (G) is active;

responsive to a determination that the processor signal (G) is inactive, determining, using the controller prior to assertion of the flame-test input control signal, the output state of the first comparator;

responsive to a determination that the output state of the first comparator is low, determining, using the controller prior to assertion of the flame-test input control signal, the output state of the second comparator;

responsive to a determination that the output state of the second comparator is high, transmitting, using the controller, a notification that a flame is not present; and responsive to a determination that the output state of the second comparator is low, transmitting, using the controller, a notification that a problem exists.

26. The method of claim 25 further comprising:

responsive to a determination that the processor signal (G) is active, determining, using the controller prior to assertion of a flame-test input control signal, an output state of a first comparator;

responsive to a determination that the output state of the first comparator is high, determining, using the controller prior to assertion of the flame-test input control signal, an output state of a second comparator; and responsive to a determination that the output state of the second comparator is low, transmitting, using the controller, a notification that a flame is present.

* * * * *